United States Patent [19]

Cheung et al.

[11] 4,074,779

[45] Feb. 21, 1978

[54] BACKWASHING SYSTEM FOR SLURRY PICK-UP USED IN HYDRAULIC BOREHOLE MINING DEVICES

[75] Inventors: John B. Cheung; Earll M. Murman, both of Kent, Wash.

[73] Assignee: The United States of America as represented by the Secretary of the Interior, Washington, D.C.

[21] Appl. No.: 794,898

[22] Filed: May 9, 1977

[51] Int. Cl.[2] ..... E21B 39/00; E21B 21/00

[52] U.S. Cl. ..... 175/314; 175/67; 175/213; 175/317

[58] Field of Search ..... 175/314, 422, 67, 213, 175/317

[56] References Cited

U.S. PATENT DOCUMENTS

| | | | |
|---|---|---|---|
| 2,678,203 | 5/1954 | Huff | 175/213 |
| 3,155,177 | 11/1964 | Fly | 175/213 |

*Primary Examiner*—James A. Leppink

*Attorney, Agent, or Firm*—Gersten Sadowsky; Donald A. Gardiner

[57] ABSTRACT

A hydraulic borehole mining device is provided of the type wherein a pair of high pressure water jets located along the length of the device are used to cut the mineral to be mined and a slurry pick-up system used to transport the particles cut away by the jets back to the ground surface. The slurry pick-up may include a slurry jet pump which is also supplied with water under pressure. The jet pump includes a jet nozzle which is directed so as to draw particles through screens that cover inlets for the particles located about the circumference of the device, and which thus entrains the particles in a slurry with the water, this slurry of water and mineral particles being pumped back to the surface. To prevent clogging or blocking of the screens such as can occur when particles accumulate thereon, a backflush or backwash valve is provided which, when actuated, blocks and deflects the water from the jet nozzle and thus causes the water flow to reverse itself and pass out through the screens to thereby provide cleaning of the screens.

6 Claims, 4 Drawing Figures

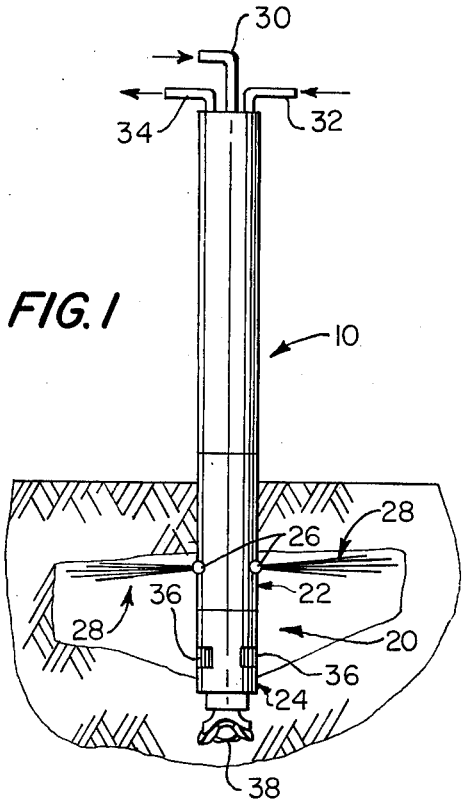
FIG. 1
FIG. 2
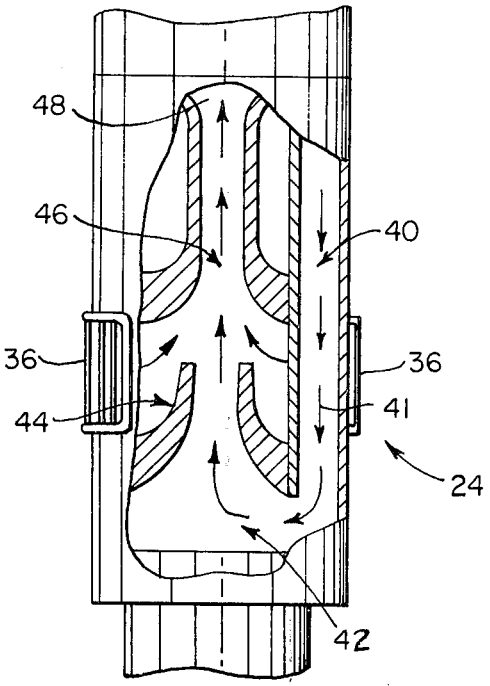
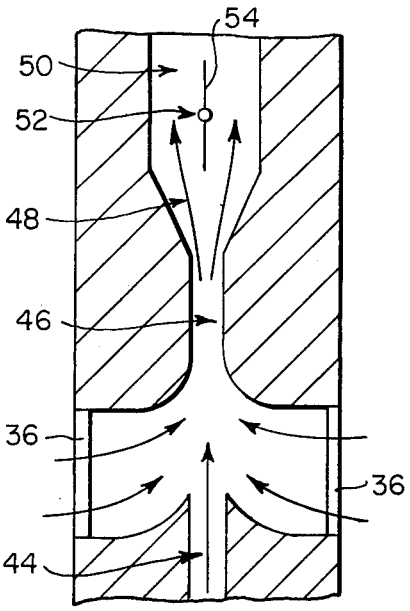
FIG. 3
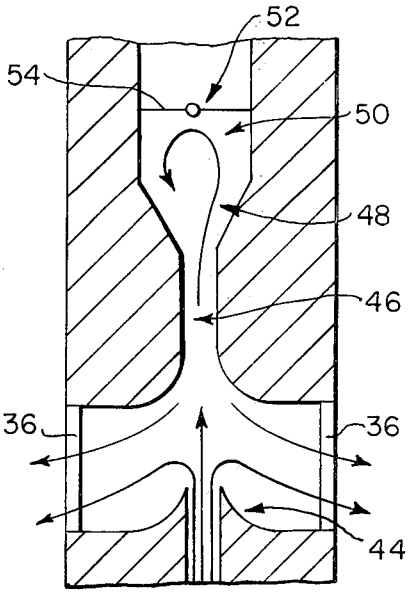
FIG. 4

BACKWASHING SYSTEM FOR SLURRY PICK-UP USED IN HYDRAULIC BOREHOLE MINING DEVICES

FIELD OF THE INVENTION

The present invention relates to a hydraulic and mechanical system for hydraulic borehole mining devices that provides a backwashing mode to prevent blocking of the intake for the mined materials.

BACKGROUND OF THE INVENTION

Hydraulic borehole mining devices of the type with which the present invention is concerned exhibit a good potential for mining underground coal from the ground surface with a minimum disturbance of the surface itself. This general technique involves the drilling of a borehole from the ground surface to the underground coal deposit and the use of a pair of high-pressure water jets produced by oppositely directed jet nozzles to cut or otherwise provide fragmentation of the coal. A slurry jet pump is used to entrain, in a slurry, the fractured coal, i.e., the coal particles, and to transport these particles back to the ground surface.

The present invention is particularly concerned with devices of this type wherein a screen is used to cover the intake or inlet apertures through which the coal is picked up. The slurry jet pump is utilized to create a suction force in the area of these intake apertures so that the coal particles are drawn in through the screens, and entrained in the water jet created by a jet nozzle supplied with inlet water from the ground surface, to form a slurry such as referred to above. The screens are used as a filter to prevent oversized particles from plugging the jet pump and/or the slurry conduits. However, while the use of such screens provides important advantages, the use of such screens also create a problem. In particular, these screens are prone to plugging or blockage by mineral particles lodged therein or accumulated thereon. Such plugging can obviously greatly limit the mineral particles which are picked up by the device and hence impair the entire operation.

SUMMARY OF THE INVENTION

The present invention incorporated in a slurry pick-up and transport system for a hydraulic borehole mining device overcomes the problems of the prior art discussed above. More specifically in a slurry pick-up and transport system wherein screens or the like are used to filter out oversized particles, a backwashing arrangement is utilized to clean off the screens and thus overcome the plugging problem discussed hereinabove. In general, the backwashing arrangement includes a backwashing valve which, in a first, normal mode, provides a normal flow of the slurry back to the ground surface, and which, in a second, backwashing mode, causes blocking and reversal of the slurry flow and a consequent cleaning off of the screens.

The slurry pick-up with backwashing system preferably includes an inlet conduit through which water under pressure is received from the ground surface and a jet pump nozzle in fluid communication with the inlet conduit and directed towards a mixing conduit of a mixing section. The mixing conduit is also in fluid communication with the intake openings covered by the screens. The backwash valve is preferably located upstream of the mixing conduit and, in a preferred embodiment, is located upstream of a further, diffusion section which is disposed directly upstream of the mixing conduit. With this arrangement, closing of the backwash valve causes a pressure build-up in the throat of the jet pump and, in turn, causes the flow from the primary jet of the jet pump to exit through the screens to thus provide a cleaning off of the particles accumulated thereon.

Other features and advantages of the invention will be set forth in, or apparent from, the detailed description of a preferred embodiment found hereinbelow.

BRIEF DESCRIPTION OF THE DRAWINGS

FIG. 1 is a schematic representation, in side elevation, of an exemplary hydraulic borehole mining device incorporating the present invention;

FIG. 2 is a detail, to an enlarged scale and partially broken away, of the mixing section of the mining device shown in FIG. 3;

FIG. 3 is a highly schematic representation of the mixing section shown in FIG. 2, illustrating a first, normal, "slurry pick-up" mode of operation; and FIG. 4 is a highly schematic representation, similar to that of FIG. 3, illustrating a second, backwashing or backflushing mode of operation.

DESCRIPTION OF THE PREFERRED EMBODIMENTS

Referring to FIG. 1, the overall configuration of an exemplary embodiment of a hydraulic borehole mining device is illustrated. The basic device can be of a form such as disclosed in U.S. Pat. No. 3,797,590 (Archibald et al) or U.S. Pat. No. 3,155,177 (Fly) and reference is made to those patents with respect to constructional details of such a device. For purpose of understanding the present invention, only the basic elements of the device will be described apart from those that provide a context for, or make up part of, the present invention, it being understood that those parts which are not specifically described can take forms known in the art. Further, while the present invention will be described relative to the mining of coal, other uses are, of course, feasible.

The hydraulic borehole device illustrated in FIG. 1 preferably comprises as elongate shell or body 10 which is made up of a series of separate sections. The section of interest here is the so-called mining section, generally denoted 20, which is located at the lowermost end of body 10 and which itself is made up of a nozzle section 22 and a mixing section 24. Nozzle section 22 includes a pair of diametrically opposed jet nozzles 26, 26 which produce coal cutting water jets indicated at 28, 28. Water for the water jets is supplied from a high pressure source (not shown) by means of a conduit 30 at an exemplary pressure of 31 $MN/m^2$. The mixing section 24, which is described in more detail hereinbelow, cooperates with a slurry jet pump (not shown) to provide picking up of the coal particles which are cut away by the jets 28, 28. These particles are transported in a slurry, with water for the slurry, at an exemplary pressure of 4.9 $MN/m^2$, being supplied to the jet pump through an inlet conduit 32, and the slurry being removed through an outlet conduit 34. The coal particles are taken in the device through a series of screens 36 which are located about the circumference of the mixing section 24, as illustrated, and which serve in screening out oversized particles. A bit 38 provides for the reduction of oversized particles.

Referring to FIG. 2, a detail of the mixing section 24 is shown, FIG. 2 being partially broken away to illustrate the slurry jet pump referred to above. As shown, mixing section 24 includes a longitudinally extending laterally offset conduit 40 which communicates with inlet 32 and thus serves in transporting water under pressure down the conduit 40, as illustrated by arrows 41, to a pump chamber 42 located near the bottom of borehole mining device 10. A jet pump nozzle 44, causes pumping of this feed water out of chamber 40 into a jet pump mixing conduit 46 which is disposed coaxially within the overall mixing section 24 and which is in fluid communication with the slurry inlets provided at screens 36, in addition to jet nozzle 44. Thus, the suction created by jet pump nozzle 44 serves to draw the coal particles into the jet pump mixing conduit 46 wherein the particles are mixed with water and a slurry thus created. As illustrated, the inlet to mixing conduit 46 is flared outwardly towards jet nozzle 44 so as to provide a smooth transition in the area in which the jet water and the particles are first intermixed. The jet pump mixing conduit 46 is in fluid communication with a tapered diffusion section 48, a portion of which is illustrated.

Referring to FIG. 3, a highly schematic representation of the mixing section 24 of FIG. 2 is provided, with the details of the construction shown in FIG. 2 omitted to simplify the discussion of the operation and with the same reference numerals being used to identify corresponding elements. The diffusion section 48, communicates, as illustrated, with a further straight section 50 which is not shown in FIG. 2 and which houses a backflush valve 52. In the mode of operation described above, backflush valve 52 is rotated to an open position wherein valve member 54 extends generally parallel to the path of flow of the slurry so that the presence of the valve member has negligible effect on the flow.

As discussed hereinabove, the principal feature of the present invention is the provision of a backwashing mode of operation wherein coal or other particles which have been accumulated on or lodged in the screens are removed. As explained, these particles can cause blockage of the screens and hence prevent the coal particles from being drawn into, or otherwise entrained, in the slurry. Referring to FIG. 4, which is a schematic diagram of the mixing section similar to that of FIG. 3, a backflushing mode of operation is illustrated which solves the problems associated with clogged or blocked screens. Thus, for the mode of operation illustrated, with backflush valve 52 closed so that valve member 54 extends perpendicular to the path of flow across flow section 50, the water from jet nozzle 44 is deflected and is caused to flow backwardly, as shown, and hence flows out through the screens 36. Thus, in this way, blocking and clogging of the screens can be prevented by instituting a backwashing operation, cyclically or as required, to clean the screens.

It will be appreciated that the exact location of the backwash valve is not critical although it is preferred that this valve be located downstream of the diffusion section so as to reduce the impact force of the jet assisted slurry which the valve member must withstand. Further, it will, of course, be understood that the backwash valve can take other forms and that, in general, the term "backwash valve" is intended to encompass any arrangement which provides substantially free flow of the slurry in a first mode of operation and provides blocking and reversing of the slurry flow in a second mode of operation.

Although the invention has been described relative to an exemplary embodiment thereof, it will be understood by those skilled in the art that variations and modifications can be effected in this embodiment without departing from the scope and spirit of the invention.

We claim:

1. In a hydraulic borehole mining device having oppositely directed cutting jets, a slurry pick-up and transport system including a plurality of particle inlets through which particles of the material cut by said jets are picked up, a like plurality of screens covering respective ones of said inlets for limiting the size of the particles picked up, slurry jet pump means for serving in pumping input fluid through said device such that said particles are drawn into the device through said inlets and entrained into said fluid to form a slurry which is transported out of said device, and including a valve means, located upstream of said inlets, for, in a first, open position thereof, permitting transporting of said slurry out of said device and for, in a second, closed position thereof, blocking the flow of said slurry and causing said inlet fluid to reverse the flow thereof out through said screens to provide cleaning of said screens.

2. A hydraulic mining apparatus as claimed in claim 1 wherein said slurry jet pump means includes a diffusion section located upstream of said mixing section and said backwash valve means is located upstream of said diffusion section.

3. A hydraulic apparatus as claimed in claim 2 wherein said backwash valve means comprises a rotatable valve member which, in the first position thereof, extends parallel to the slurry flow and, in the second position thereof, extends perpendicular to the slurry flow so as to block said flow and cause said reverse flow.

4. A hydraulic apparatus as claimed in claim 1 wherein said particle inlets comprise a plurality of apertures in said device located in equally spaced relationship around the circumference of said machine adjacent to the lowermost end thereof, above said pump chamber.

5. A hydraulic apparatus as claimed in claim 1 wherein said backwash valve means comprises a valve member which is movable between a first position wherein said member extends parallel to the flow of said slurry and a second position wherein said valve member extends perpendicular to the flow of said slurry.

6. A hydraulic apparatus as claimed in claim 1 wherein said particle inlets comprise a plurality of apertures located in equally spaced relationship about the circumference of said device adjacent to the lowermost end thereof.

* * * * *